US005967197A

United States Patent [19]

Shown

[11] Patent Number: 5,967,197

[45] Date of Patent: Oct. 19, 1999

[54] DRINKING WATER DELIVERY SYSTEM

[76] Inventor: Richard L. Shown, P.O. Box 2077, Glen Ellen, Calif. 95442

[21] Appl. No.: 09/056,108

[22] Filed: Apr. 6, 1998

[51] Int. Cl.[6] ..... B65B 1/04

[52] U.S. Cl. ..... 141/18; 141/114; 141/327; 141/330; 141/364; 222/81; 222/83.5; 222/94; 222/185.1

[58] Field of Search ..... 141/18, 114, 330, 141/327, 363, 364; 222/81, 83.5, 94, 185.1

[56] References Cited

U.S. PATENT DOCUMENTS

| | | | |
|---|---|---|---|
| Re. 32,354 | 2/1987 | Savage | 222/81 |
| 562,823 | 6/1896 | Heysinger | 141/18 |
| 648,904 | 5/1900 | Hart | 141/363 |
| 1,018,924 | 2/1912 | Patnaude | 222/185.1 |
| 1,142,210 | 6/1915 | Wagner | 222/185.1 |
| 2,528,530 | 11/1950 | Machleder | 141/363 |
| 2,719,628 | 10/1955 | Ivanoff | 141/364 |
| 3,288,178 | 11/1966 | Johnson | 141/330 |
| 3,653,413 | 4/1972 | Sheya | 141/18 |
| 3,970,121 | 7/1976 | Brandt | 141/18 |
| 4,322,019 | 3/1982 | Smith | 222/83.5 |
| 4,953,752 | 9/1990 | Tousignant et al. | 222/185.1 |
| 4,991,635 | 2/1991 | Ulm | 141/346 |
| 5,060,701 | 10/1991 | McCunn et al. | 141/364 |
| 5,105,858 | 4/1992 | Levinson | 141/18 |
| 5,163,587 | 11/1992 | Apps et al. | 222/185.1 |
| 5,192,004 | 3/1993 | Burrows . | |

*Primary Examiner*—J. Casimer Jacyna
*Attorney, Agent, or Firm*—Donald N. MacIntosh; Flehr Hohbach Test Albritton & Herbert

[57] ABSTRACT

A system for delivery and refilling a dispenser of potable liquids provides a delivery container with rigid sidewalls and refill liquid containers with flexible sidewalls. Complimentary fitments on the dispenser and refill containers permit leak free docking under ascetic conditions when transferring liquid from the refill container into the liquid dispenser. The refill containers are easy to lift and handle, are used one time only and are then recycled. When empty the delivery container is nestable with others.

7 Claims, 3 Drawing Sheets

DRINKING WATER DELIVERY SYSTEM

FIELD OF THE INVENTION

This invention pertains to a system for the delivery of potable liquids including drinking water, milk, tea, coffee, fruit juices, fermentable liquids or the like, and more particularly concerns the aseptic resupply and easy replenishment of the potable liquid with respect to a dispenser therefor.

BACKGROUND OF THE INVENTION

The traditional system for providing drinking water in offices, factories and homes includes a cabinet like drinking water dispenser for holding in the inverted position a five gallon glass or plastic bottle. Water flows from the open neck of the inverted bottle into a well portion of the dispenser from which, upon demand, the water flows by gravity through a conduit to a faucet actuated by the user seeking drinking water. Typically, one or more five gallon bottles are placed by the delivery person adjacent to the dispenser cabinet so that as one bottle is depleted it may be dismounted from the dispenser and a full bottle weighing about 45 lbs. may be mounted with a lift from the floor, and inverted into the dispenser cabinet. It is well known that a substantial effort is required to lift 45 lbs. from the floor to a position about 3½ ft. there above and to invert the bottle. Persons of modest strength have difficulty completing the task of raising and inverting the fill bottle of drinking water but nevertheless, it must be accomplished periodically. The labor to deliver the containers to the place of use is considerable. The investment in transport equipment to carry the refill containers is substantial.

Generally, the filled bottle of drinking water is closed by a removable cap which is stripped away from the neck of the bottle usually by the person reloading the water dispenser. While lifting, it is convenient but unsanitary for that person to place his/her hand on the bottle neck after the cap is removed. This has been an occasion of the drinking water becoming contaminated from germs from the hands. Presently, there is no way to safeguard handling the water refill bottle in a germ free condition so as to protect the drinking water from contamination. Further, when the empty bottle is removed from the dispenser well for a period of time, air borne materials could settle into the well and afford yet another point of contamination of the drinking water.

The traditional system for providing drinking water with respect to a dispenser cabinet requires that the water bottles be transported from the water bottle filling plant to the customer. Then the bottles are returned to the plant in the empty state. The two way transport in handling of rigid bottle accounts for a substantial amount of the cost and capital in a commercial drinking water delivery system. It would be highly desirable if the drinking water could be delivered and the container therefore retrieved in a compact state and sent on for recycling. The same conditions hold for other human consumable liquids and even syrups and condensed liquids such as coffees or teas, milk and the like.

In the prior art the usefulness of a pouch for holding a resupply of chemical additives, viscous soaps, industrial metal cutting lubricants or the like was recognized. The U.S. Pat. No. 4,322,019 to Smith discloses a pouch containing a viscous liquid soap for refilling liquid soap dispensers. There is no particular need in that or other applications for maintaining these liquids in an aseptic condition being that those liquids are not intended for human ingestion. The principal concern then was to maintain control over the liquid against leakage during the refill operation. Providing a seal over the neck of a water bottle wherein the seal is pierced during installation into a water cooler is shown in the Wagner U.S. Pat. No. 1,142,210. Avoidance of undesirable skin contact with a liquid contained within a pouch or sachet is disclosed in U.S. Pat. No. 3,288,178 to Johnson wherein an attachment is provided to the bottle to be filled, the attachment serving to penetrate the pouch so that the corrosive liquid may drain without human contact into the associated bottle. None of the prior pouch systems showing membrane puncture or adapter structure therefore were intended and designed to be used in an aseptic drinking water delivery system.

SUMMARY OF THE INVENTION AND OBJECTS

The present invention provides for the easy replenishment of a potable liquids including drinking water at a dispenser therefore and forms a novel drinking water dispensing system which facilitates refilling of a dispenser in a tidy, aseptic manner. This is accomplished in the present invention in providing a storage and transfer container with substantially rigid sidewalls for holding a plurality of bladders of a combined volume of at least three times the volume of the liquid to be contained as a supply in the associated liquid dispenser. The bladders have flexible sidewalls and are sealed to maintain the potable liquid in a substantially aseptic state. The bladder includes a neck of substantially non-flexible construction opening at one end into the bladder and scaled at the other with a planar stretched film seal. The liquid dispenser includes a docking fitment at an upper portion thereof having an inner wall complimentary to the neck of the bladder so as to fit together for transferring liquid such as water from the bladder to the dispenser. A piercing element within the docking adapter serves to penetrate the seal on the pouch or bladder for connecting the interior of the pouch permitting water to flow into the filling dispenser.

An object of the present invention is to provide for aseptic transfer of potable liquids such as drinking water from a supply thereof maintained in pouches or bags and for the emptying of the pouches one at a time into a reservoir or water storage receptacle.

Another object of the invention is to provide a system for the delivery of potable liquids r which is a substantially a one way system wherein the individual liquid delivery containers may be disposed of without the need to be returned for refilling.

Another object of the invention is to provide in a system of the type described for a storage facility containing the pouches or bladders of water for ready introduction into the reservoir bottle.

Yet another object of the invention is to provide for the delivery of the drinking water in bladders or pouches which may be readily handled by persons of slight build, the pouches or bladders weighing in the filled condition normally less than 20 lbs.

Yet another object of the invention is to provide in a system of the type described for the delivery of drinking water in a substantially aseptic state and which may be readily cleaned and visually inspected for maintenance of the unit in a very sanitary state.

A further object of the invention is to provide a system for supplying and dispensing drinking water, milk, fruit juices, fermented liquids and the like which incorporates therein a flexible bladder of the type set forth.

Further features of the invention pertain to the particular arrangement of parts of the liquid delivery system and the system whereby the above outlined an additional operating features thereof are attained.

The invention both as to its organization and method of operation, together with further features and advantages thereof will best be understood with reference to the following specification taken in connection with the accompanying drawings.

DESCRIPTION OF THE PREFERRED EMBODIMENT

Figure 1:
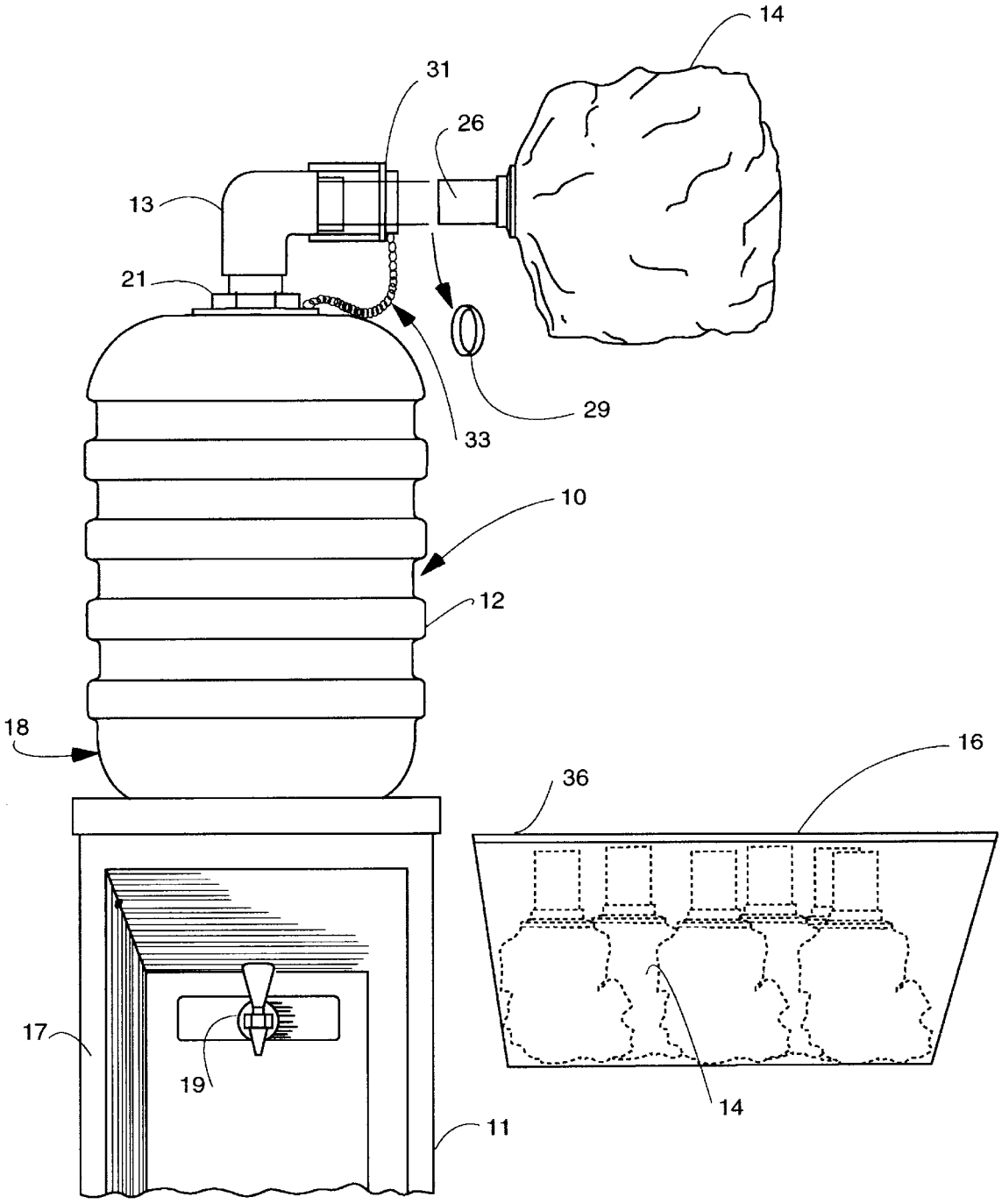
FIG. 1 is an elevation view, partially broken away, of the potable liquid dispensing system of the present intention.

Referring to FIG. 1 of the drawings, there is illustrated as an exemplar of the invention a drinking water delivery system 10 which comprises a water dispenser cabinet pedestal 11, an inverted bottle of reservoir 12, a refill fitment 13, a refill bladder 14 and a delivery and holding container 16 serving to contain a supply of the water refill bags or bladders 14. The delivery system 10 is designed and configured to permit the easy resupply of drinking water or other potable liquid and yet maintain a minimum number of surfaces for contamination during the water refilling operation as appears from the description below.

The water dispenser pedestal 11 may be of the type installed in offices, homes or factories and is supported from a floor surface (not shown) and includes a cabinet 17 of generally rectangular cross section, although this is not important, and has at the upper portion of the cabinet 17 a centrally disposed recess or well (not shown) for receiving the neck of the inverted bottle 12 and as well as to afford the support for the bottle shoulder 18. Thus, the position of the reservoir or bottle 12 is stable with respect to the cabinet 17 and it will be understood that the bottle 12 is removable therefrom so that the well (not shown) may be visually inspected and easily cleaned with an aseptic cloth, sponge or the like. A toggle actuated faucet 19 is normally mounted on the front panel of the cabinet 17 and those seeking drinking water simply position a paper cup or other personal drinking container beneath the faucet 19 to receive delivery of the needed liquid.

Figure 2:
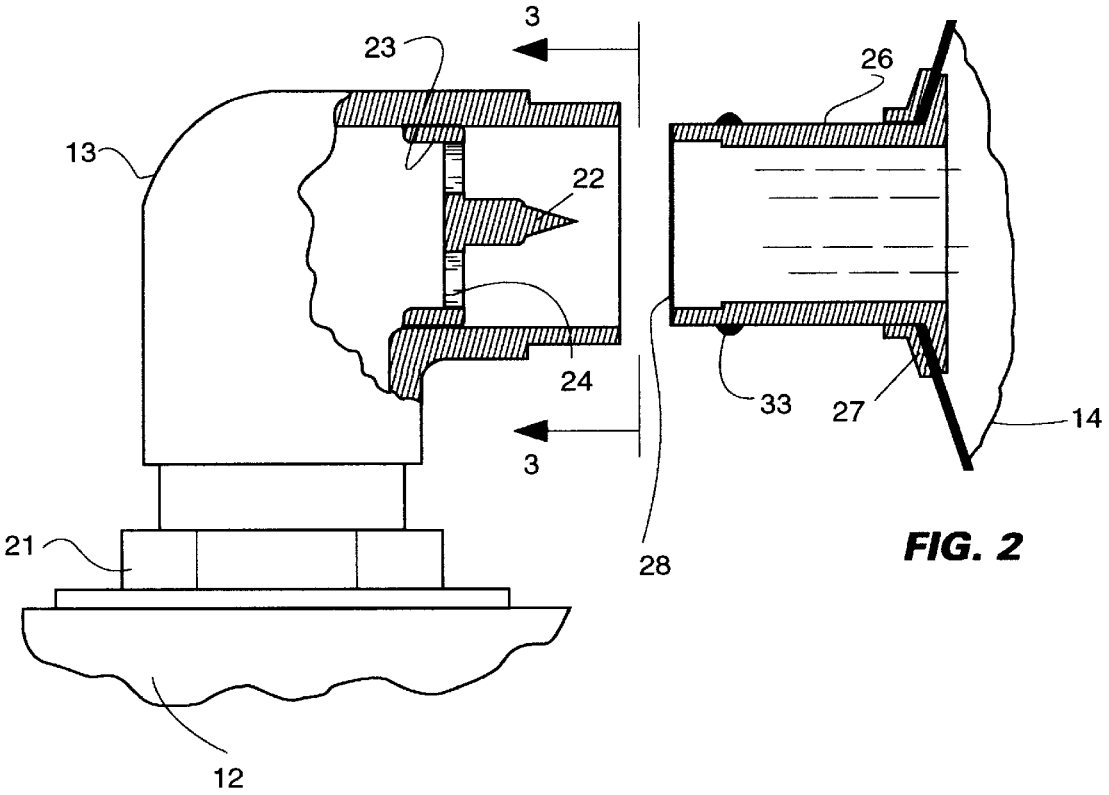
FIG. 2 is an enlarged view, partially broken away illustrating the pre-installation position of the full supply bag with respect to the fitment located at an upper portion of the dispenser reservoir.
Figure 3:
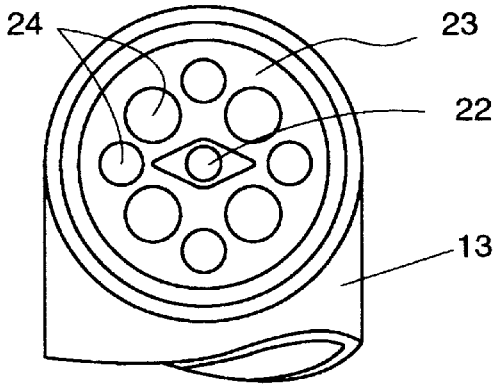
FIG. 3 is a sectional view taken in the direction of the arrows 3—3 in FIG. 2.

The reservoir or bottle 12 may be constructed as a standard blow-molded water cooler bottle with a 5 to 6 gallon capacity. Bottles of this general configuration are in widespread use by numerous water delivery companies. As viewed in FIG. 1, the reservoir bottle 12 is arranged in a normal inverted position wherein water flows outwardly from the bottle neck (not shown) disposed in the well of the cabinet 11. The portion of the bottle 12 which is normally the "bottom" is for the purposes of this invention equipped with a docking fitment 12 which may be formed from a moldable, sanitary grade plastic material, and, as indicated in FIGS. 1–3, is circular in transverse section. Most conveniently, the fitment may be formed as a 90° turn or "elbow" and may be mounted to the bottle 12 at a base 21 in any appropriate manner that ensures a strong, water tight fit such as by cementing, plastic welding or the like. The mounting of the fitment to the bottle must be of sufficient rigidity to serve over a long service life for the insertion of the water refill bags or bladders and the forces this operation imposes.

Referring now to FIGS. 2 and 3, it will be recognized that the elbow shaped fitment 13 has a generally horizontally disposed "leg" which is provided with a centrally mounted pintle 22 which is preferably formed from stainless steel and is integral with a supporting disc like retainer 23. The retainer 23 is provided with a plurality of apertures 24, 8 being illustrated in FIG. 3 although the number is not especially critical for the practice of this invention. The retainer 23 may be pressed into the bore of the horizontal leg of the fitment 13 and is set back or recessed a distance sufficient to permit entry and water tight lodging of the docking neck 26 of the refill bag or bladder 14.

More particularly, the refill bag or bladder 14 may be formed from 4-mil 2 ply linear, low density polyethylene with ethylene vinyl acetate component and having a capacity in the range of 0.75 to nominally 2½ gallons which at most when filled with water weighs approximately 21 lbs. This weight is readily lifted by people of even slight physical build and strength whereas the 5 gallon bottle presently used requires substantial physical strength and balance for installation in the water dispenser. The refill or delivery bag 14 is equipped with a rigid docking neck 26 which is snarlingly secured at its base 27 to the collapsible bag sidewall material. In the filled condition of the bag, the neck is provided with a frangible seal 28 stretched over the entire opening of the neck and adapted for puncture by the pintle 22 when the neck is inserted into the end of the fitment 13. After filling at the plant, so as to maintain the seal 28 in an aseptic condition, a cap 29 is pressed over the end of the neck 26 to cover the seal. The cap is removed only at the time when the refill bag will be placed in use to restock the water in the reservoir 12. It will be understood that the cap 29 as well as the bladder 14 are disposable elements in this system in the sense that they are not returned to the plant for reuse but are recycled as an ecologically sound practice.

Figure 5:
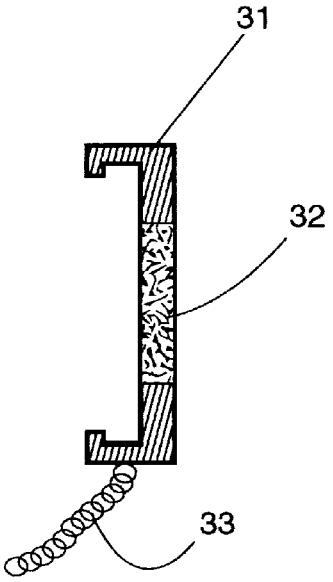
FIG. 5 and FIG. 6 are sectional and end views respectively of the vent cap mountable on the dispenser's fitment.
Figure 6:
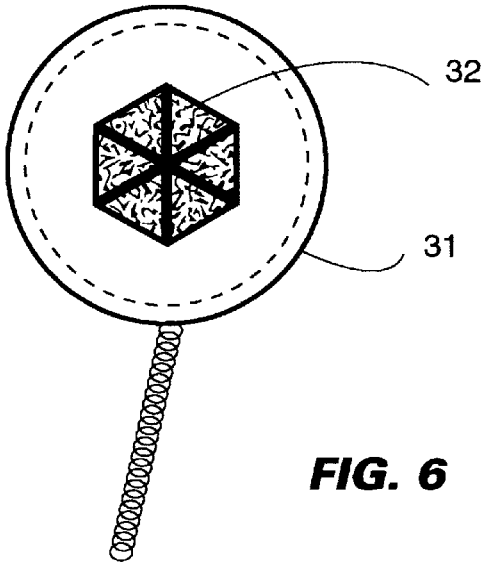

Similarly, the open end of the fitment 13 is provided with a cap 31 as shown in FIGS. 1, 5 and 6. The cap 31 is provided with a centrally arranged vent 32 for the admission of air into the reservoir 12 as water is withdrawn. The vent 32 may be formed from a non-organic fiber material impregnated with anti-bacterial and anti-fungal agents of food grade. A keeper chain 33 is attached to the cap 32 and the base 21 of the docking fitment to ensure that the cap 31 will always be available and in place to cover the opening of the fitment 13 when that opening is not otherwise serving a water refilling function.

Figure 4:
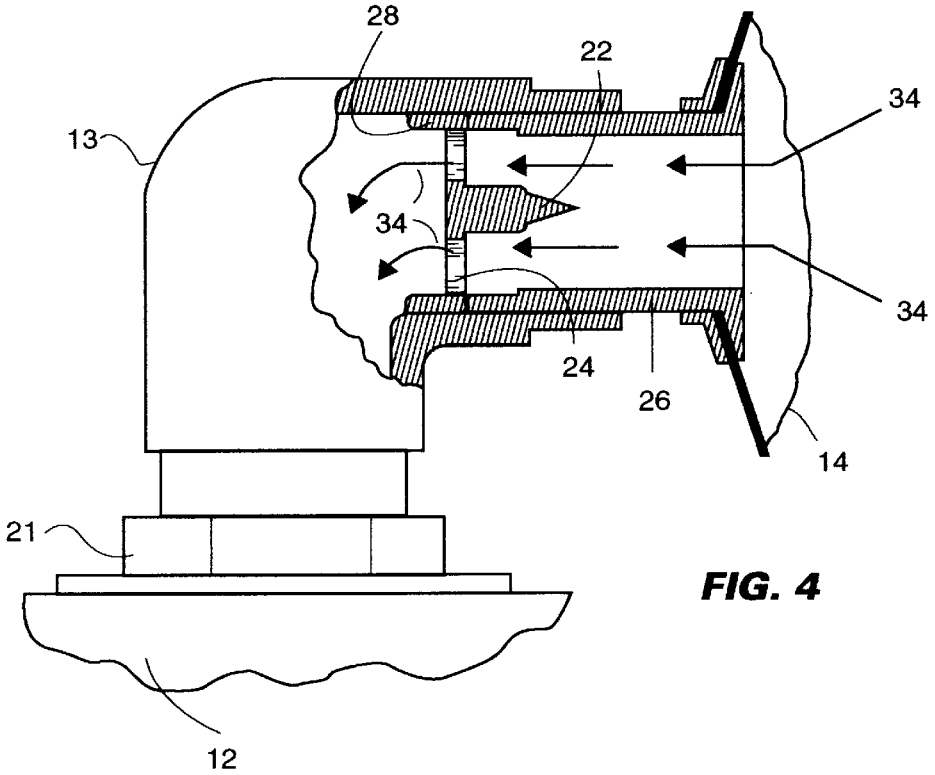
FIG. 4 is a view like FIG. 2 but illustrating the installation position of the supply bag with respect to the dispenser's fitment as liquid flows from the bag into the dispenser reservoir.

Referring again to FIG. 2, it will be appreciated that the docking neck 26 and the open end of the fitment are shaped and sized complementally so that the parts telescope together in a water tight seal. A variety of configurations will work and the disclosed shaped is one satisfactory exemplar. To ensure a leak tight seal a molded O ring like element 33 is arranged on the neck 26 to establish a good seal between the mating parts. Referring to FIG. 4, it will be appreciated there is shown there the condition which exists when the parts are telescoped together after the pintle 22 has penetrated the seal 28 so that the water may flow in the direction of the arrows 34 through the fitment 13 and then down into the reservoir 12. The full refill bladder 14 is easily lifted and handled during the insertion of the neck 26 into the fitment 13 and with a slight forward pressure, the seal engages the pintle 22 and as the parts are pressed home, water will begin to flow from the bag into the reservoir 12. The handler of the bag will recognize by its feel when the bag is empty and thereupon withdraw the neck 26 from the fitment and return the cap 32 to its position of closure over the fitment end. The bag 14 may then be placed for recycling.

Referring to FIG. 1, the delivery end storage container 16 may be characterized as a tote-box and may be formed from impact resistant material generally having the dimensions of 24"×19½"×12½". A storage container of this size will hold ten 2½ gallon refill bags of water and will weigh on the order of 220 lbs. This amount of weight is readily movable with a hand truck or the equivalent mechanical cart from the water delivery truck to the customers locale and then placed adjacent to the water dispenser 10 so that the refill bladders are readily accessible. A hinged cover 36 may be provided on the container 16 and fashioned in such way that several containers are nestable together after all the water supply bags have been removed. The tote-box is quite compact for the volume of drinking water contained therein and is an improvement over the present polycarbonate bottles used for drinking water resupply. For ease of explanation and illustration a water delivery system has been considered here although it will be understood that the principles of the present invention are applicable to refill systems for other liquids including coffee and tea concentrate, juices, milk as well as fermentable liquids which are all best handled under high aceptic conditions.

While I have described what is at present considered to be the preferred embodiment of the invention, it will be understood that various modifications may be made therein, and it is intended to cover in the appended claims all such modifications as filed within the true spirit and scope of the invention.

What is claimed is:

1. A system for facilitating easy replenishment of a potable liquid with respect to a dispenser therefor comprising in combination a storage and transfer container with substantially rigid sidewall with a capacity for holding in bladders a multiple of at least three times the volume of liquid contained within the associated dispenser;

a plurality of bladders with flexible sidewalls serving to contain a volume of replacement liquid and maintain it in a substantially aseptic state, each bladder including a neck of substantially non-flexible construction opening at one end into the bladder, planar sealing means mounted on another end of said bladder neck;

a liquid dispenser including a dispensing faucet, a reservoir bottle mountable in said dispenser and having a volume which is a multiple of the volume of a plurality or said bladders;

a filling receptacle mounted at an upper portion of said reservoir bottle and co-operable with said bladder neck for transfer of the contents of said bladder into said reservoir bottle; and cover means for mounting and dismounting with respect to said filling receptacle during storage and liquid refilling conditions serving to maintain the reservoir bottle in a substantially aseptic state.

2. The combination of claim 1 wherein a distal end of said bladder neck is configured and sized to engage telescopically and to be received in said filling receptacle and means within said receptacle serving to engage and penetrate said planar seal affording free passage of the potable liquid into said reservoir bottle and thence to said liquid dispenser.

3. The combination of claim 2 wherein dismountable cap means are provided in a covering relationship over said planar seal of said bladder neck.

4. The combination of claim 2 wherein a flexible member couples said cover means of said filling receptacle to said reservoir bottle.

5. The combination of claim 2 wherein said bladders are formed of a material such that in their empty condition the bladders may be readily compacted into a small volume for recycling purpose.

6. The combination of claim 5 wherein said storage and transfer container is configured and sized such that in the empty condition it may nest with a like container serving to economize on occupied space wherein awaiting the return for refilling with the potable liquid containing bladders.

7. The combination of claim 2 wherein the liquid containment volume of said reservoir bottle is on the order of 5 gallons and the liquid containment volume of said bladders is in the range of from 0.75 to 2½ gallons.

* * * * *